United States Patent [19]

Hösel

[11] Patent Number: 4,870,854

[45] Date of Patent: Oct. 3, 1989

[54] METHOD OF CALIBRATING AN APPARATUS FOR DETECTING THE FILL LEVEL IN A FIBER STORING DEVICE

[75] Inventor: Fritz Hösel, Mönchengladbach, Fed. Rep. of Germany

[73] Assignee: Trützschler GmbH & Co. KG, Mönchengladbach, Fed. Rep. of Germany

[21] Appl. No.: 250,448

[22] Filed: Sep. 28, 1988

Related U.S. Application Data

[62] Division of Ser. No. 65,567, Jun. 23, 1987.

[30] Foreign Application Priority Data

Jun. 23, 1986 [DE] Fed. Rep. of Germany ..... 3621009

[51] Int. Cl.[4] ..... G01F 25/00

[52] U.S. Cl. ..... 73/1 H; 250/577; 250/341; 364/571.08; 73/293; 141/95

[58] Field of Search ..... 73/1 H, 293; 364/571.01, 571.02, 571.05, 571.08; 141/95; 250/577, 341

[56] References Cited

U.S. PATENT DOCUMENTS

| | | | |
|---|---|---|---|
| 3,821,558 | 6/1974 | Mansfield | 250/577 |
| 4,247,784 | 1/1981 | Henry | 250/577 |
| 4,354,180 | 10/1982 | Harding | 250/577 X |
| 4,396,911 | 8/1983 | Motsinger et al. | 250/577 X |
| 4,487,065 | 12/1984 | Carlin et al. | 364/571.01 X |
| 4,501,972 | 2/1985 | Foerster, Jr. et al. | 250/577 |
| 4,623,264 | 11/1986 | Mitchell | 73/1 H X |

FOREIGN PATENT DOCUMENTS 2330499 1/1975 Fed. Rep. of Germany ..... 73/1 H

OTHER PUBLICATIONS

"Cyrogenic Level Measuring System With Thermal Stabilization of the Transducer Mounting" Measurement Techniques vol. 25, No. 1, Jan. 1982, pp. 59–61; A. L. Seifer et al.

*Primary Examiner*—Tom Noland

*Attorney, Agent, or Firm*—Spencer & Frank

[57] ABSTRACT

A method of calibrating and adjusting an apparatus for determining the fill level of a selected specific fiber material in a filling chute of a fiber storing device. The apparatus includes an optical device situated above an expected maximum fill level in the filling chute and having a light emitter arranged to direct a light beam from above onto an upper face of the fiber material and a light detector arranged to receive a light beam reflected from the upper face, a microcomputer, including a microprocessor, operatively connected to the apparatus for receiving detector signals from the apparatus. The calibrating method comprises the steps of providing two vertically spaced fixed markings on a side wall of the filling chute; charging the filling chute with a fiber material of a specific type; generating detector signals when the level of the fiber material in the filling chute reaches the lower and the upper marking, respectively, whereby the generated detector signals represent two known height levels of the fiber material of specific type; and storing the generated detector signals in the microcomputer, whereby calibration of the apparatus for the fiber material of the specific fiber type is obtained.

3 Claims, 2 Drawing Sheets

METHOD OF CALIBRATING AN APPARATUS FOR DETECTING THE FILL LEVEL IN A FIBER STORING DEVICE

This is a division of application Ser. No. 65,567 filed Jan. 23, 1987.

BACKGROUND OF THE INVENTION

This invention relates to a method and an apparatus for determining the fill level of the fiber material in a fiber storing device, such as a filling chute, filling chamber, or the like, with the aid of an optical device comprising a light source and a light detector. The fiber material storing device is used particularly in conjunction with a fiber processing machine in the phase of spinning preparation.

In the phase of fiber processing for the spinning preparation it is necessary to know the exact fill level of the fiber material in the fiber storing device and corresponding processing machines. This is of particular importance if in a fiber processing line a continuous material feed has to be maintained.

In a known apparatus as disclosed, for example, in German Gebrauchsmuster (German Utility Model) No. 1,971,420, the fill level in the storing device is determined by means of an optical barrier which is mounted in a side wall of the filling chute. The photocell-equipped measuring device detects a fill level either when the fiber material covers the photocell or when it is situated therebelow. In this manner a fill level of the filling chute is determinable solely to the extent whether a single predetermined fill level is reached. Further actual fill levels of the fiber material in the filling chute, that is, the extent of the momentary fill height of the fiber material column in the fiber storing device cannot be ascertained with such prior art apparatus.

SUMMARY OF THE INVENTION

It is an object of the invention to provide an improved apparatus of the above-outlined type which avoids the discussed disadvantages and which, in particular, supplies, at low installation costs, a continuous information concerning the actual fill level in the fiber storing device.

This object and others to become apparent as the specification progresses, are accomplished by the invention, according to which, briefly stated, the optical fill-level sensing device is arranged above the expected maximum fill level (top face) of the fiber material and the light emitted by the light source is reflected by the upper material surface and received by the light detector.

By virtue of the electron-optical device which emits a light beam reflected from the surface of the fiber column and received in a detector and which, as a function of the intensity of the received light beams emits an analog signal, the actual fill level in the material storing device can be determined. Since the closer the material level to the light emitter and/or the detector, the greater the intensity of the reflected rays, the signal emitted by the light detector directly represents the distance between the material level and the sensor.

The optical device which may be formed of a plurality of sensors (emitters and detectors) may be a one-way optical barrier or a reflecting layer type optical barrier (with reflector). Preferably, the optical device is a light scanner, where the light beams are reflected by the upper face of the material column. While visible or invisible light may be used, preferably an infrared light emitter and light detector device is installed in the fiber storing device. Expediently, the detector is adapted to generate an analog electric signal as a function of the intensity of the received light beams. Preferably, the output signals of the receiver are applied to an input of an analog/digital converter which applies digital signals to a microprocessor of a microcomputer. Since the intensity of the reflected light beams also depends from properties (for example, color) of the fiber material, the signal obtained from the analog/digital converter cannot be directly utilized and therefore, the microprocessor interprets the signal based on "material-specific" considerations.

It is a further advantage of the apparatus according to the invention that by using a microprocessor, the apparatus is, on its own, capable of determining additional data necessary for the run of the process, applying such data to the central computer (master computer) and may thus lighten its workload. For example, the supply and removal speed of the fiber material, limit values, fill level tendencies or use analyses may be determined.

Expediently, the microprocessor is connected with a memory as well as an inputting and retrieving device.

The invention also encompasses a process for setting (calibrating and adjusting) the fill level measuring device at the fiber storing arrangement, particularly for operating the inventive device. According to the method, at a side wall of the storing device (filling chute) there are superpositioned two stationary markings, and when the fill level of the fiber column reaches the markings during charging, an electric reference signal is applied to the computer. The electric reference signal is applied to the microprocessor manually or by means of the light detector of the optical device.

DESCRIPTION OF THE PREFERRED EMBODIMENTS

Figure 1:
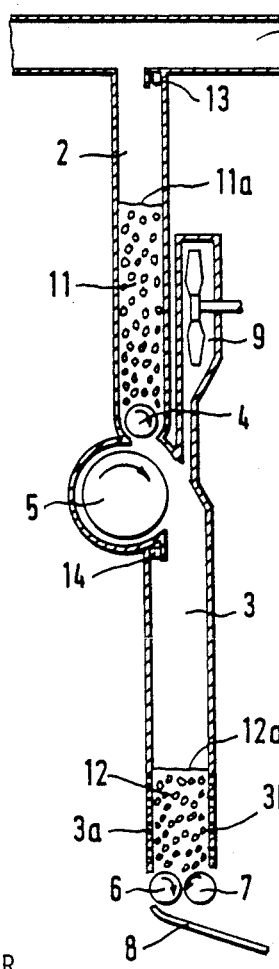
FIG. 1 is a schematic sectional side elevational view of a fiber tuft feeder incorporating the invention.

Turning to FIG. 1, there is illustrated a known fiber tuft feeder 1 which may be an "EXACTAFEED FBK" model which supplies a fiber lap to a card, such as an "EXACTACARD DK 3" model, both manufactured by Trützschler GmbH & Co. KG, Mönchengladbach, Federal Republic Germany. The tuft feeder 1 has an upper reserve chute 2 and a lower feed chute 3 as well as a feed roller 4 and an opening roller 5 which advance the fiber tufts from the reserve chute 2 to the feed chute 3. At the lower end of the feed chute 3 there are provided cooperating pull-off rollers 6 and 7 which withdraw the fiber material from the feed chute 3 and advance it as a fiber lap to a feed tray 8, from which, in turn, the fiber lap is admitted to the non-illustrated carding machine. The feed chute 3 communicates with a compressing fan 9 which generates a compressing air stream introduced into the feed chute 3 for compressing the fiber column therein. In the lower zone of the feed chute 3 there are provided a plurality of air outlet openings 3*a*, 3*b*. The upper reserve chute 2 is connected to a pneumatic fiber tuft transporting duct 10 which is coupled to an upstream located fine opener and in which a fiber material conveying fan (not shown) is situated. The tuft fill in the reserve chute 2 and in the feed chute 3 are designated at 11 and 12, respectively.

Figure 1B:
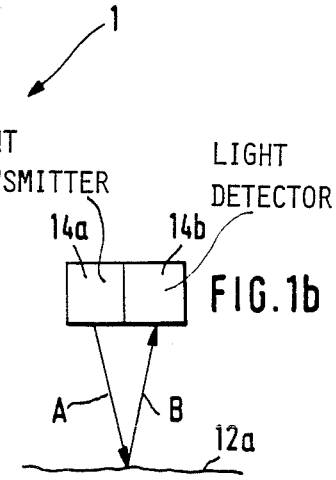
FIGS. 1*a* and 1*b* are a schematic side elevational illustrations of light scanners with transmitter and detector, according to a preferred embodiment of the invention.
Figure 1A:
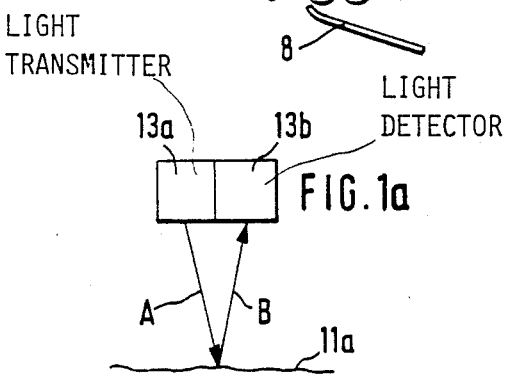

In the reserve chute 2, above the fiber material column 11, there is arranged a light scanner 13 which, as illustrated in FIG. 1*a*, is formed of a light transmitter 13*a* and a light detector 13*b*. The light transmitter 13*a* emits a scanning infrared light beam A in a generally downwardly oriented (vertical) direction. The beam B reflected by the upper face 11*a* of the material column 11 is admitted in the detector 13*b*. Similarly, in the feed chute 3, above the upper face 12*a* of the fiber tuft column 12 there is mounted a light scanner 14 which, as illustrated in FIG. 1*b* is formed of a light transmitter 14*a* and a light detector 14*b*. The light scanner 14 is structured and is functioning similarly to the light scanner 13 in conjunction with the top face 12*a* of the fiber tuft column 12 in the feed chute 3.

Figure 2:
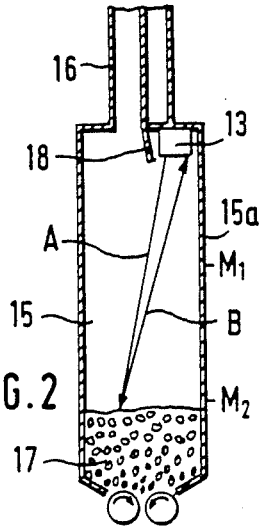
FIG. 2 is a schematic side elevational view of a feed chute incorporating the preferred embodiment illustrated in FIG. 1*a* and arranged for practicing the invention.

Turning now to FIG. 2, there is shown therein a filling chute 15, for example, for a cleaner or similar apparatus in which fiber tufts 17 are introduced from the top by a filling device 16. At the upper end of the filling chute 15, in the vicinity of the feed inlet opening, a deflecting baffle 18 is arranged which directs the fiber tufts downwardly into the space of the filling chute 15. The light scanner 13 is mounted at the upper end of the filling chute 15 between the baffle plate 18 and one of the vertical walls 15a. On the side wall 15a there are provided two vertically spaced stationary markings $M_1$ and $M_2$.

Figure 3:
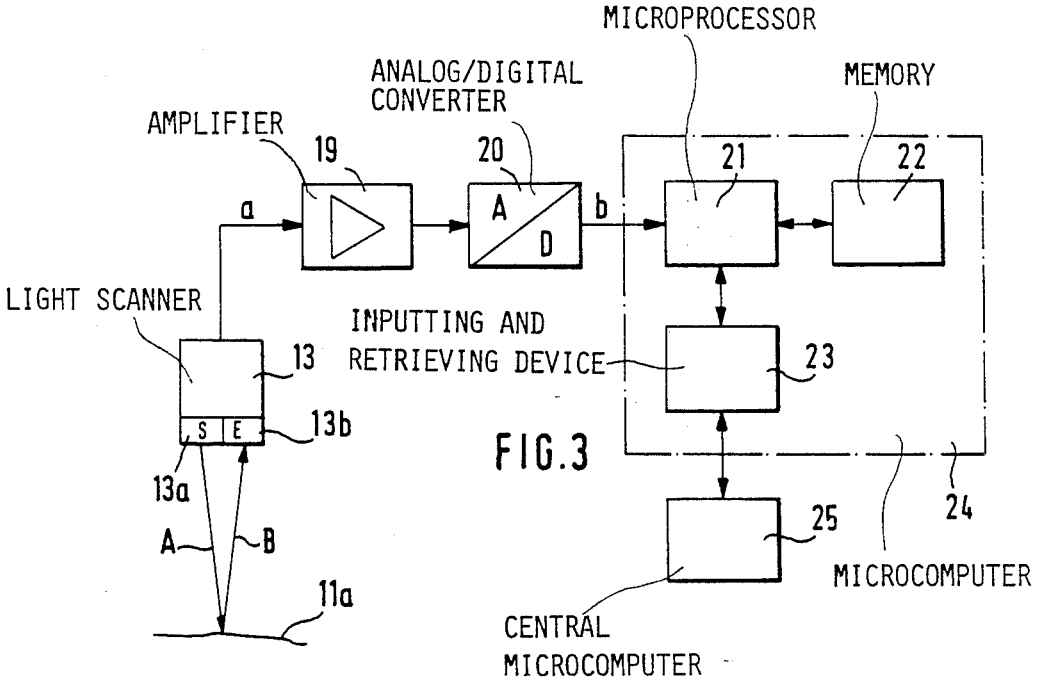
FIG. 3 is a schematic side elevational view of a light scanner, with block diagram for processing signals generated by the light scanner.

Turning now to FIG. 3, there is shown the light scanner 13, including the light transmitter 13*a* and the detector 13*b* which directs the scanning light beam A against the generally horizontal surface 11*a* from which the light is reflected and introduced into the detector 13*b* as a reflected beam B. The light scanner 13 generates an analog detector signal a which is representative of the intensity of the detected reflected beam B and which is applied to an amplifier 19. The latter, in turn, applies the amplified analog signals to an analog/digital converter 20 which applies the converted (digital) signal b to a microprocessor 21 of a microcomputer 24. The microprocessor 21 is connected with a memory 22 and with an inputting and retrieving device 23. The latter is connected with a central microcomputer 25. Since the closer the material surface 11*a* to the transmitter 13*a* and/or the detector 13*b*, the greater the intensity of the reflected beam B, the signal a of the detector 13*a* is a direct measure for the distance between the material surface 11*a* and the light scanner 13.

Assuming that the detector 13*b* of the light scanner 13 emits a signal a which is linearly proportionate to the light beam intensity, the apparatus according to the invention may be set (calibrated and adjusted) in a manner now to be described.

Figure 4:
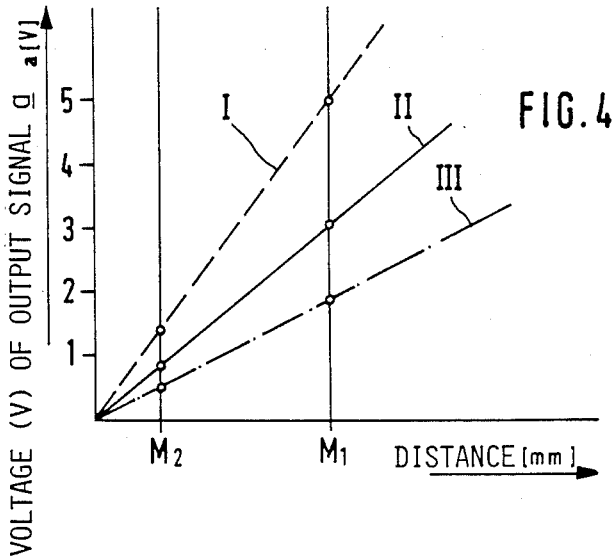
FIG. 4 is a diagram illustrating an output signal voltage as a function of the distance of the setting points or the height levels of the fiber column for different fiber materials.

The setting is carried out for each type of material once or in a continuous manner. At the filling chute 15 (FIG. 2) on two windows two markings $M_1$ and $M_2$ are provided so that by external visual inspection it may be determined the moment the fiber material level reaches these markings. The distance (vertical spacing) between the markings is fixed and has a known magnitude (for example, 1 m). As the empty filling chute 15 is being filled and the material level reaches the lower mark $M_2$, the attendant applies a signal to the microprocessor 21 (for example, with a key). The microprocessor 21 stores the momentary value received from the analog/digital converter 20 (first setting point). When the material level reaches the upper mark $M_1$, the step is repeated and the second setting point is obtained. By virtue of the two setting points, the microprocessor 21 is now capable of calculating, based on material-specific considerations, the signal b received from the analog/digital converter 20 and report the same through an inputting and retrieving interface 23 to the central microcomputer 25. Also referring to FIG. 4, the obtained setting points or curves have to be determined once for each fiber material I, II or III. In the filling chute 15 the material is deposited by type. Upon change of fiber material, the central microcomputer 25 emits the information as to the type of material which is being processed and the device may work according to the available setting curves and report the corresponding filling level to the central microcomputer 25.

If, instead of the two marks $M_1$ and $M_2$ two light barriers are used, the setting procedure may be carried out automatically and a continuous adjustment may take place during operation.

The invention was described in an example in connection with a filling chute for the feeding of cards, cleaners or beaters. It may equally find application in fiber material storage devices for mixers or mixing chambers. In general, the fiber material is applied to the fiber material storing device in a loose tuft form and is subsequently compressed by its own weight, pneumatically or by vibrations imparted thereto.

The present disclosure relates to subject matter contained in Federal Republic of Germany Patent Application No. P 36 21 009.9 (filed June 23rd, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method of calibrating and adjusting an apparatus for determining the fill level of a selected specific fiber material in a filling chute of a fiber storing device; said filling chute having a side wall; said apparatus including an optical device being situated above an expected maximum fill level in the filling chute and including a light emitter arranged to direct a light beam from above onto an upper face of the fiber material and a light detector arranged to receive a light beam reflected from said upper face, a microcomputer, including a microprocessor, operatively connected to said apparatus for receiving detector signals from said apparatus; comprising the steps of providing two vertically spaced fixed markings on said side wall; charging said filled chute with a fiber material of a specific type; generating detector signals when the level of the fiber material in the filling chute reaches the lower and the upper markings, respectively, whereby the generated detector signals represent two known height levels of the fiber material of specific type; and storing the generated detector signals in the microcomputer, whereby calibration of the apparatus for the fiber material of said specific type is obtained.

2. A method as defined in claim 1, wherein said generating step is manually triggered.

3. A method as defined in claim 1, wherein said light emitter is an infrared light emitter and said light detector is an infrared light detector, wherein said generating step including the steps of generating said detector signals in response to said infrared light emitter.

* * * * *